United States Patent [19]

Tanaka et al.

[11] Patent Number: 4,809,532

[45] Date of Patent: Mar. 7, 1989

[54] METHOD OF MANUFACTURING SPLIT RING SPRINGS FOR SNAP FASTENERS

[75] Inventors: Akira Tanaka, Kurobe; Kenji Hasegawa, Uozu, both of Japan

[73] Assignee: Yoshida Kogyo K. K., Tokyo, Japan

[21] Appl. No.: 109,514

[22] Filed: Oct. 19, 1987

[30] Foreign Application Priority Data

Oct. 20, 1986 [JP] Japan ..... 61-249294

[51] Int. Cl.[4] ..... B21F 37/02; B21F 45/16

[52] U.S. Cl. ..... 72/337; 72/339; 72/403; 140/88; 24/674

[58] Field of Search ..... 72/402, 403, 398, 337–339, 72/330, 331; 29/173, 5; 140/88; 59/27, 23, 24; 24/674

[56] References Cited

U.S. PATENT DOCUMENTS

| | | | |
|---|---|---|---|
| 1,244,448 | 10/1917 | Berg | 59/23 |
| 1,417,397 | 5/1922 | Lewis | 72/337 |
| 1,936,611 | 11/1933 | Young | 72/403 |
| 1,973,436 | 9/1934 | Hjort | 72/402 |
| 3,166,827 | 1/1965 | Bushi | 72/402 |
| 4,621,515 | 11/1986 | Sanderson et al. | 72/403 |

FOREIGN PATENT DOCUMENTS

| | | | |
|---|---|---|---|
| 13659 | 8/1956 | Fed. Rep. of Germany | 72/403 |

*Primary Examiner*—Daniel C. Crane

[57] ABSTRACT

A split ring spring for snap fasteners has a burr extending from each end of the ring spring in a direction parallel to the imaginary central axis of the ring spring. When a stud member is snapped with a socket member in which the split ring spring is incorporated, the burrs do not damage or scar a body of the stud member. The ring spring having such unobjectionable burrs is produced by feeding a length of a strip of resilient material transversely across a mandrel, then severing the length off the strip in a direction parallel to the longitudinal axis of the mandrel while holding the length on the mandrel, and thereafter bending the severed length of strip around the mandrel.

3 Claims, 7 Drawing Sheets

METHOD OF MANUFACTURING SPLIT RING SPRINGS FOR SNAP FASTENERS

BACKGROUND OF THE INVENTION

1. Field of the Invention

The present invention relates to a split ring spring for snap fasteners such as snap-fit buttons, and a method of manufacturing such split ring spring.

2. Prior Art

As shown in FIG. 5 of the accompanying drawings, a snap-fit button 1 for garment fabrics is composed of a male or stud member 2 and a female or socket member 3 which are attached to a pair of garment fabric pieces C, C, respectively, by means of tacks 4, 5. The socket member 3 includes a split ring spring 6 into which a body 7 of the stud member 2 is snap-fitted to connect the two fabric pieces C, C.

In the manufacture of such ring spring 6, it has been customary practice to first wind a continuous wire W of resilient material around a mandrel 8 and then sever an individual turn of the coiled wire W by a cutter 9 which is reciprocably movable in a direction perpendicular to the longitudinal central axis of the mandrel 8, as shown in FIG. 6.

With this severance, there are produced two burrs 10*a*, 10*b* projecting respectively radially inwardly and outwardly from the severed opposite ends of a finished ring spring 6. If the ring spring 6 having such burrs 10*a*, 10*b* were incorporated in the socket member 3 as shown in FIG. 5, the stud body 7 would be scarred or damaged by the radially inwardly projecting burr 10*a* when the stud and socket members 1, 2 are snapped together. The stud member 1 thus scarred is unsightly in appearance. Another problem is that the burrs 10*a*, 10*b* hinder smooth coupling and uncoupling of the stud and socket members 1, 2.

SUMMARY OF THE INVENTION

It is accordingly an object of the present invention to provide a split ring spring for snap fasteners which is snappingly engageable with the body of a mating stud member smoothly without damaging the stud body.

Another object of the present invention is to provide a method of manufacturing such split ring spring.

According to the present invention, a split ring spring for snap fasteners; comprising an interrupted circular strip of resilient material having confronting opposite ends, each end having a burr extending in a direction parallel to the imaginary central axis of the interrupted circular strip.

The split ring spring is manufacturing by (a) feeding a length of a continuous strip of resilient material tansversely across a mandrel; (b) thereafter holding the length on the mandrel; (c) cutting the length off the continuous strip in a direction parallel to the longitudinal central axis of the mandrel while maintaining the holding of the length on the mandrel; and (d) then bending the severed length of strip around the mandrel while maintaining the holding of the length on the mandrel, thus producing an interrupted circular resilient strip.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
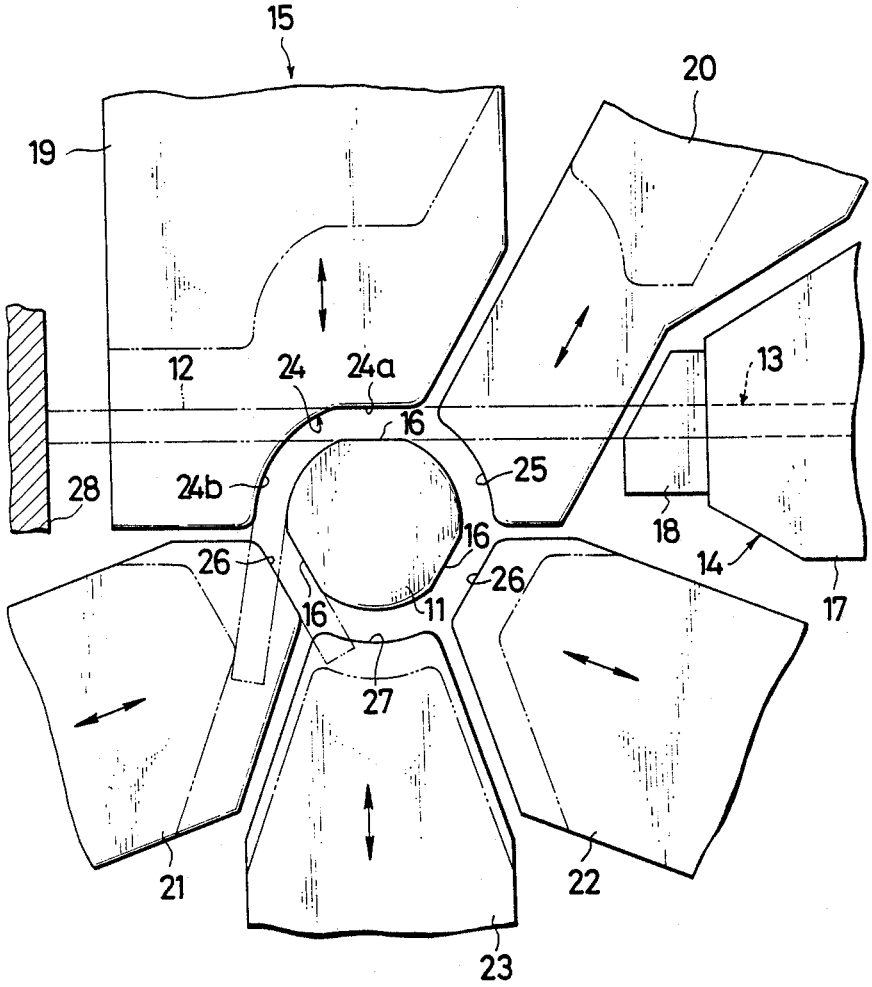
FIG. 1 is a plan view of an apparatus for manufacturing a split ring spring according to the present invention.

FIG. 1 shows an apparatus for manufacturing a split ring spring according to the present invention. The apparatus generally comprises a mandrel 11 around which a length 12 of a continuous strip 13 of resilient material is wound, a cutting unit 14 for cutting the length 12 off the strip 13, and a multi-stage shaping unit 15 for bending the severed length 12 of strip around the mandrel 11.

The mandrel 11 has a generally circular cross-sectional shape and includes a plurality (three in the illustrated embodiment) of flat peripheral portions 16 extending longitudinally thereof and circumferentially spaced at equal angular intervals. The flat peripheral portions 16 serve as shaping dies for stably supporting thereon portions of the length 12 of strip when the latter is processed by the shaping unit 15, as described later on. The number of the flat peripheral portions 16 is not limited to three as in the illustrated embodiment. Further, the mandrel 11 having such flat portions 16 is preferable, but a mandrel of a complete circular cross section is still within the scope of the invention.

The cutting unit 14 is disposed on one side of the mandrel 11 and includes a movable cutting punch 17 and a stationary die 18 disposed on opposite sides of a path of movement of the length 12 of strip. The path of movement extends transversely across the mandrel 11 in substantially tangential relation to the mandrel 11. The cutting punch 17 is reciprocably movable toward and away from the die 18 in a direction parallel to the longitudinal central axis of the mandrel 11 for cutting the length 12 of strip off the continuous strip 13. This severance ensures that a finished split ring spring has burrs extending from its severed opposite ends in the same directions as the movement of the cutting punch 17.

The multi-stage shaping unit 15 includes a plurality (five in the illustrated embodiment) of shaping punches 19–23 disposed circumferentially around the mandrel 11 in juxtaposed relation to one another. The shaping punches 19–23 are reciprocably movable toward and away from the longitudinal central axis of the mandrel 11. The first shaping punch 19 is disposed on one side of the path of movement of the length 12 of strip and is movable toward the mandrel 11 to hold the length 12 of strip on the mandrel 11. The first shaping punch 19 has a combined flat-and-arcuate shaping surface 24 complementary in contour to a part of the peripheral surface of the mandrel 11 including one of the flat peripheral portions 16. The combined shaping surface 24 is composed of a flat shaping surface portion 24*a* facing toward the flat peripheral portion 16, and an arcuate shaping surface portion 24*b* extending continuously from the flat shaping surface portion 24*a*. It is possible to replace the first shaping punch 19 with a pair of shaping punches having a flat shaping surface and an arcuate shaping surface, respectively. The second shaping punch 20 is disposed between the cutting unit 14 and the first shaping punch 19 and has an arcuate shaping surface 25 complementary in contour to an arcuate peripheral surface portion of the mandrel 11 extending between two flat peripheral portions 16, 16. The third and fourth punches 21, 22 are disposed on the opposite side of the path of movement of the length 12 of strip 13 and are located respectively adjacent to the first and second shaping punches 19, 20. The third and fourth shaping punches 21, 22 are structurally and functionally identical with each other and have respective flat shaping surfaces 26 confronting to the corresponding flat peripheral portions 16 of the mandrel 11. The fifth shaping punch 23 is disposed between the third and fourth shaping punches 21, 22 and has an arcuate shaping surface 27 complementary in contour to an arcuate peripheral surface portion of the mandrel 11 extending between adjacent two flat peripheral portions 16, 16.

The apparatus also includes a stopper 28 disposed on the opposite side of the mandrel 11 in confronting relation to the cutting unit 14 for stopping advancing movement of the continuous strip 13 when the latter is fed over and across the mandrel 11. The stopper 28 is spaced from the cutter unit 14 by a distance equal to the individual length 12 of strip to be cut off from the continuous strip 13.

Operation of the apparatus is described below with reference to FIGS. 2A through 2F.

Figure 2A:
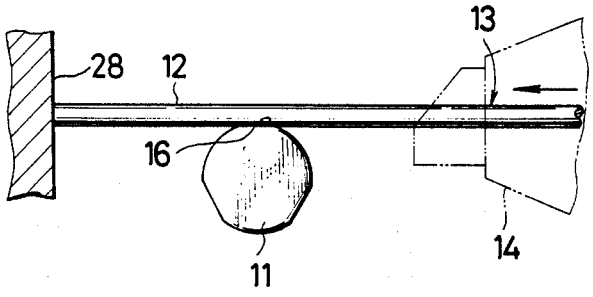
FIGS. 2A through 2F are schematic plan views illustrative of successive steps of operation of the apparatus.

As shown in FIG. 2A, a continuous strip 13 of resilient material such as a spring wire is fed along a longitudinal path toward the stopper 28 by means of a reciprocably movable gripper (not shown). When the leading end of the strip 13 engages the stopper 28, a length 12 of strip extends between the stopper 28 and the cutter unit 14 transversely across the mandrel 11. Then the supplied length 12 of strip is locked in position against displacement by the gripper.

Figure 2B:
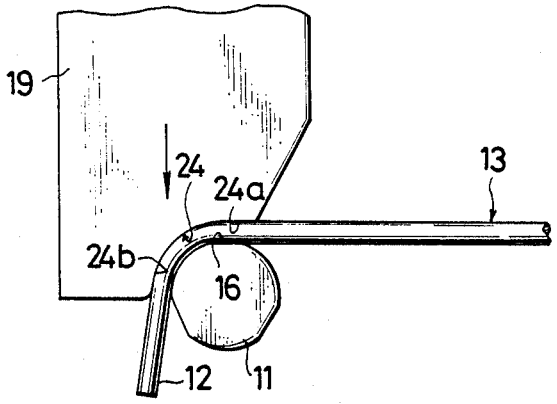

Thereafter, the first shaping punch 19 is advanced toward the mandrel 11 to grip the length 12 of strip 13 by and between the first shaping punch 19 and the mandrel 11. In this instance, the combined flat-and-arcuate shaping surface 24 forces the length 12 of strip to bend around the corresponding peripheral part of the mandrel 11, as shown in FIG. 2B.

Figure 2C:
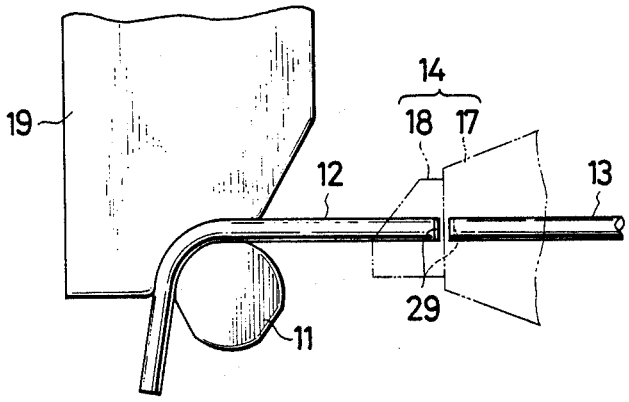

While maintaining the holding of the length 12 of strip 13 on the mandrel 11, then the cutting punch 17 of the cutting unit 14 is driven to move toward the die 18, thereby cutting the length 12 off the strip 13, as shown in FIG. 2C. With this severance, there are produced two burrs 29 projecting respectively from the trailing end of the severed length 12 of strip and the leading end of the next prospective length of strip. Since the cutting punch 17 reciprocates in a direction parallel to the longitudinal axis of the mandrel 11, the burrs 29 thus produced also extend flush with confronting severed end faces in the same direction as the movement of the cutting punch 17 (i.e. parallel to the longitudinal central axis of the mandrel 11).

Figure 2D:
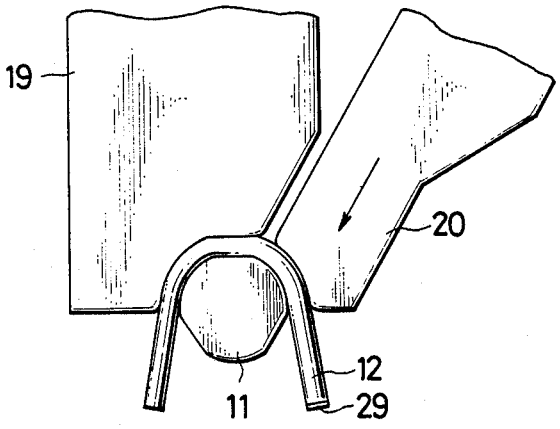

Thereafter, the second shaping punch 20 is advanced to bend a severed side of the length 12 of strip around the corresponding peripheral part of the mandrel 11, thus shaping the length 12 of strip into an inverted U (FIG. 2D). During that time, the first shaping punch 19 is held in its advanced shaping position to hold the length 12 of strip on the mandrel 12.

Figure 2E:
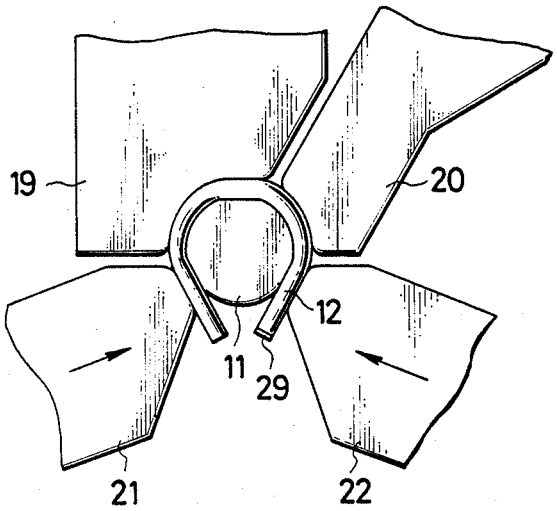

Then the third and fourth shaping punches 21, 22 are advanced simultaneously to force legs of the inverted U-shaped length 12 of strip inwardly against the mandrel 11, as shown in FIG. 2E. In this instance, it is preferable to hold the first and second shaping punches 19, 20 in the illustrated advanced positions, however, the second shaping punch 20 may be retracted away from the mandrel 11.

Figure 2F:
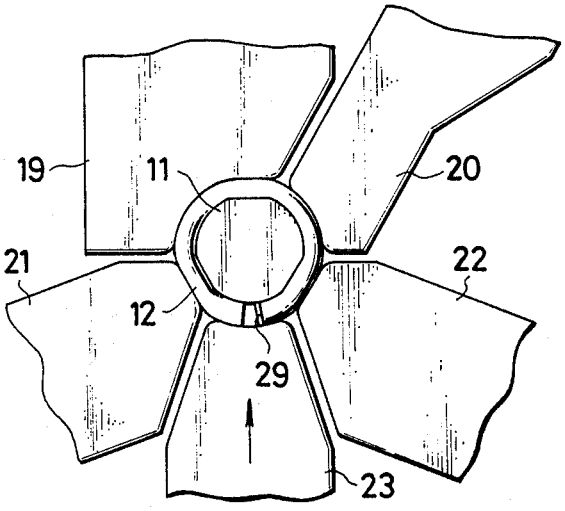
Figure 3:
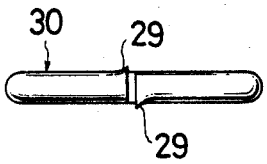
FIG. 3 is a side view of a split ring spring manufactured according to the invention.
Figure 4:
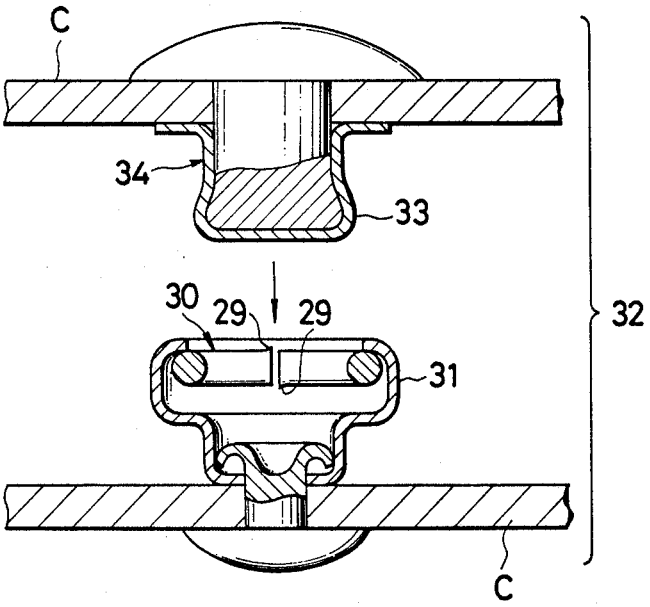
FIG. 4 is a cross-sectional view of a snap-fit button composed of a stud member and a socket member in which the ring spring of FIG. 3 is incorporated.

Finally, the fifth shaping punch 23 is advanced toward the mandrel 11 to bend the opposite ends of the length 12 of strip around the mandrel 11, thus producing an interrupted circular resilient strip, as shown in FIG. 2F. During that time the first to fourth shaping punches 19–22 are held in their advanced positions, however, a satisfactory bending of the length 12 of strip is accomplished even when the length 12 of strip is being held on the mandrel 11 only by means of the first shaping punch 19. All the shaping punches 19–23 are then returned to their retracted standby positions indicated by phantom lines shown in FIG. 1. The interrupted circular resilient strip thus formed thus constitutes a split ring spring 30 as shown in FIG. 3. The ring spring 30 is then removed from the mandrel 11 by means of an air nozzle disposed adjacent to the mandrel 11 or a mechanical scraper slidable along the mandrel (neither shown).

As shown in FIG. 3, the ring spring 30 has burrs 29 left on its opposite ends and extending in a direction parallel to the imaginary central axis of the ring spring 30.

Figure 5:
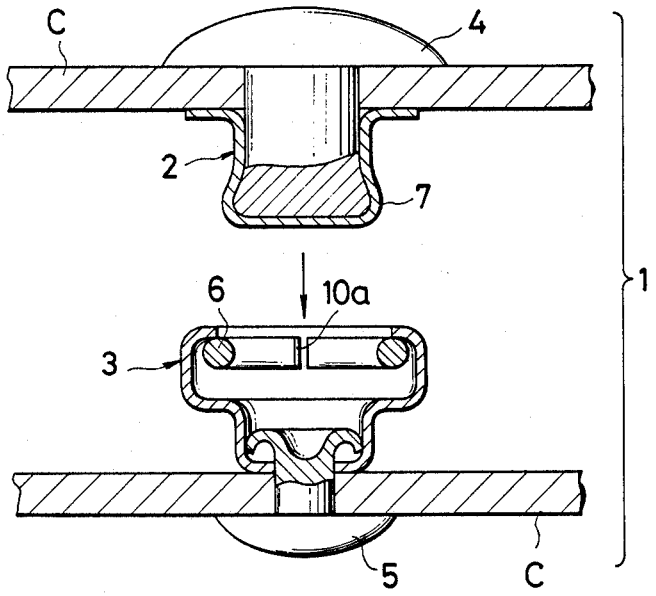
FIG. 5 PRIOR ART
FIG. 5 is a view similar to FIG. 4, but showing a prior art snap-fit button.
Figure 6:
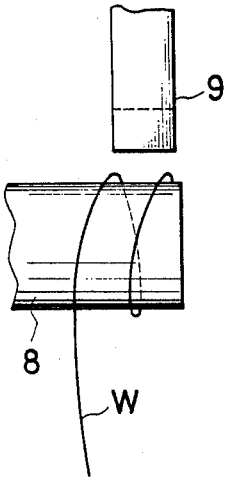
FIG. 6 PRIOR ART
FIGS. 6 and 7 are diagrammatic views showing a conventional method of manufacturing a split ring spring.
Figure 7:
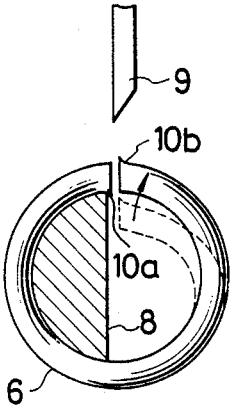
FIG. 7 PRIOR ART

This formation of the burrs 29 is in sharp contrast to the formation in the prior art in which burrs 10*a*, 10*b* extend radially inwardly and outwardly of the split ring spring 6, as shown in FIGS. 5 and 7. The split ring spring 30 is incorporated in a socket member 31 of a snap-fit button 32, as shown in FIG. 3. Since the burrs 29 on the ring spring 30 project parallel to the imaginary central axis of the ring spring 30, they do not scar or damage the body 33 of a mating stud member 34, nor hinder movement of the stud body 33 when the stud and socket members 34, 31 are snapped together to connect two garment fabric pieces C, C. As described above, the burrs 29 on the split ring spring 30 of the invention are not objectionable and do not exert any negative influence on the appearance and function of the snap fastener.

Obviously, many modifications and variations of the present invention are possible in the light of the above teaching. It is therefore to be understood that within the scope of the appended claims, the invention may be practiced otherwise than as specifically described.

What is claimed is:

1. A method of manufacturing a split ring spring for snap fasteners, comprising the following steps in the order named:

(a) feeding a length of a continuous strip of resilient material transversely across an elongate mandrel, the mandrel having a generally circular cross-sectional shape with a longitudinal axis and including a plurality of flat peripheral portions extending longitudinally thereof and circumferentially spaced at equal angular intervals;

(b) holding said length on the mandrel by moving a shaping punch radially inwardly toward the mandrel to grip a portion of the length of strip between a flat shaping surface of the shaping punch and one of the flat peripheral portions of the mandrel;

(c) cutting said length off the continuous strip by moving a cutting punch in a direction parallel to the longitudinal axis of the elongate mandrel while maintaining the holding of said length on the mandrel; and (d) bending said severed length of strip around the mandrel while maintaining the holding of said length on the mandrel, thus producing an interrupted resilient circular ring spring for a snap fastener with burrs produced on the ends of the strip by the cutting step extending parallel to the imaginary central axis of the ring spring.

2. A method as recited in claim 1, wherein said step of cutting the length includes reciprocating the cutting punch toward and away from a mating die in a direction parallel to the longitudinal central axis of the mandrel.

3. A method as recited in claim 1, wherein said step of bending the severed length of strip includes driving a plurality of shaping punches disposed around the mandrel in circumferential intervals, to move radially inwardly toward the mandrel in timed relation to one another.

* * * * *